428-406 SR
PTU53 XR 4,228,207

United States Patent [19]
Porte et al.

[11] 4,228,207
[45] Oct. 14, 1980

[54] THREE-DIMENSIONAL SHAPED ARTICLES

[75] Inventors: Pierre Porte, Lyon; Jean Togny, Sainte-Foy-les-Lyon, both of France

[73] Assignee: Societe Civile d'Etudes et de Recherches pour L'Obtention de Fibres Minerales (S.E.R.O.F.I.M.), Paris, France

[21] Appl. No.: 937,791

[22] Filed: Aug. 29, 1978

[30] Foreign Application Priority Data

Sep. 8, 1977 [FR] France ..... 77 27686

[51] Int. Cl.[2] ..... D04C 1/04

[52] U.S. Cl. ..... 428/80; 87/7; 87/11; 428/257; 428/367; 428/397; 428/902; 428/246

[58] Field of Search ..... 87/7, 8, 9, 11; 428/36, 428/246, 257, 367, 369, 397, 902, 293, 294

[56] References Cited

U.S. PATENT DOCUMENTS

| | | | |
|---|---|---|---|
| 2,041,950 | 5/1936 | Purce | 87/9 |
| 2,114,274 | 4/1938 | Huppert | 87/7 |
| 2,393,530 | 1/1946 | Harris | 87/9 |
| 2,707,318 | 5/1955 | O'Donnell | 87/7 |
| 3,936,336 | 2/1976 | Phillips | 428/367 |

FOREIGN PATENT DOCUMENTS

| | | |
|---|---|---|
| 1261491 | 1/1972 | United Kingdom . |
| 1305198 | 1/1973 | United Kingdom . |
| 1307016 | 2/1973 | United Kingdom . |

OTHER PUBLICATIONS

"Braiding and Braiding Machinery", W. A. Douglass, 1964.

*Primary Examiner*—James J. Bell
*Attorney, Agent, or Firm*—Stevens, Davis, Miller & Mosher

[57] ABSTRACT

The present invention relates to flexible, three-dimensional articles consisting of a flexible, two-dimensional, unimpregnated, braided structure based on yarns or tows preferably having a high modulus of elasticity and possessing a varying cross-section. These articles are intermediates in the production of shaped articles which are both strong and light.

8 Claims, 1 Drawing Figure

THREE-DIMENSIONAL SHAPED ARTICLES

Figure 1:
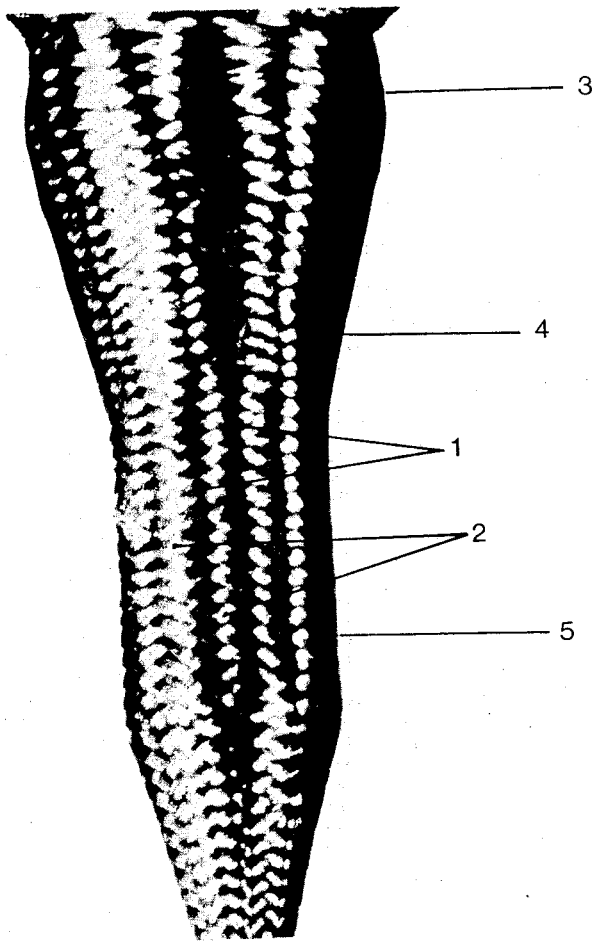

The present invention relates to flexible, three-dimensional, shaped articles consisting of a braided structure based on yarns or tows and the process for their production.

More particularly, it relates to shaped articles of varying cross-section, which are used as an intermediate in the production of rigid structures.

It is already known to make flexible articles of cylindrical shape using a spooling technique, but a technique of this kind does not make it possible to obtain articles of variable cross-sectional shape with uniform laying-down of the material.

It is also known to make shaped articles out of fabric by cutting them from a pattern, but in a technique of this kind it remains difficult to shape the articles and does not make it possible to obtain non-developable surfaces without creating heterogeneities.

Flexible, three-dimensional, shaped articles have now been invented which consist of a flexible, continuous, two-dimensional, unimpregnated, braided structure, which is preferably of varying cross-section.

The braided structure may consist of yarns or tows which cross one another at a constant angle, which is chosen at will, or at a variable angle over the entire length of the article. Varying the angle makes it possible to obtain structures having a constant mass per unit surface area, even with a varying cross-section, and therefore to adapt the properties of the finished article (for example elasticity and elongation) to the use requirements.

The shaped articles according to the present invention consist or consist essentially of a braided structure having any desired shape including, in particular, non-developable shapes.

Furthermore, the thickness of the braided structure may be varied at will, according to the result desired, by varying the gauge of the elementary yarns and tows, by varying the tightness of the said braid (that is to say, the choice of the angle at which the yarns cross one another, which angle may also be varied even during the operation), and, finally, by varying the number of superposed layers.

Finally, the yarns and tows used may be of a different nature, depending on the intended use of the final article.

In the case where it is desired to lay down several layers, it is generally preferred to fix each lower layer by means of a glue, an intermediate non-slip layer, an adhesive film, or the like, this layer depending on the nature of the yarns or tows used.

The invention applies more particularly to high-modulus yarns which moreover possess a high tensile strength and/or a high breaking force, that is to say yarns of at least 50 g/tex and preferably of at least 100 g/tex. High modulus yarns are obtained by spinning polymers of inorganic origin, such as boron, glass, carbon, graphite and silicon carbide; filaments of organic origin which may be mentioned as suitable are those originating from polymers which generally contain aromatic nuclei to which rigid radicals are fixed. Examples of these polymers which may be mentioned are aromatic polyamides and, more particularly, those which are para-substituted, of the poly-para-phenylene terephthalamide or poly-para-benzamide type, arylaliphatic polyamides or copolyamides of the polyhexamethylene terephthalamide type, or copolyamides originating from saturated or unsaturated aliphatic, aromatic and/or cyclanic diacids and aromatic or aliphatic diamines; copolyamides derived, more particularly, from terephthalic acid or adipic acid and tetramethylenediamine or para-phenylenediamine, such as those described in French Application No. 2,272,118, published on Dec. 19, 1975, polyoxadiazoles, such as polyarylene-1,3,4-oxadiazole, copolyoxadiazoles originating from a mixture of isophthalic acid and terephthalic acid, or one of the latter and aliphatic or cyclanic diacids, and polymers based on polyvinyl alcohol which have a high tensile strength and a high modulus.

The invention also applies to industrial yarns of the heat-stable type, that is to say those which possess a high heat resistance (350°–500° C.) and are based on polymers, either of the polyamide-imide type originating from the reaction of a diamine or one of its derivatives with an acid anhydride or one of its derivatives, or of the aromatic polyamide type obtained by reacting an aromatic diacid or one of its derivatives with a diamine or one of its derivatives, it being possible for these polymers to be modified by introducing an acid group.

In the case where particularly good performance must be obtained, high-performance yarns having a modulus of elasticity under tension of at least 2,000 hectobars, and preferably at least 12,000 hectobars, are used.

Yarns are to be understood as meaning groups of continuous filaments formed when such filaments are brought together in a single operation, yarns and cable yarns formed by twisting, doubling or interlacing a certain number of these filaments, and spun yarns consisting of discontinuous fibers and combinations of discontinuous fibers and continuous filaments.

The process according to the present invention consists or consists essentially in carrying out circular braiding, the braiding angle being varied, during the operation, in accordance with the shape which it is desired to obtain. The braiding angle is the angle formed by the axis of the yarn or tow and that of the machine, the latter axis being identical to that of the item being manufactured.

The laying down of the yarns and tows is carried out flat by using a circular braiding machine having rotating tensioning bars and yarn-guides, the braided structure being laid down over a former which is intended to hold the article.

A process of this kind moreover possesses the advantage that it permits the use of very fragile articles, such as carbon or graphite, which is not possible using processes known hitherto.

It is also possible to introduce strengthening yarns into the braided structure which are parallel to the axis of the article, and of the same nature or of a different nature, for the purpose of providing better support for the braided structure.

The flexible articles thus obtained are intermediates in the production of rigid and light items having desired performance properties, depending on the material used, it being possible for these performance properties to be modified by using different materials in the same article. In order to do this, the flexible articles are impregnated with any suitable resin which is capable of imparting sufficient rigidity to the articles.

The finished articles are particularly valuable for applications requiring strength and lightness, such as certain sports articles (tennis racket frames, boat masts and archery bows) or industrial applications such as the storage of corrosive products.

The accompanying drawing shows one specific embodiment of the invention (see Example 2 below) merely for purposes of illustration.

In the FIGURE, reference numeral 1 indicates carbon tows, reference numeral 2 indicates glass fibers, reference numeral 3 indicates the cylindrical part having a greater diameter, reference numeral 4 indicates the truncated cone part, and reference numeral 5 indicates the second smaller cylindrical part.

EXAMPLE 1

This item which is covered is a molded item in the shape of a truncated cone, which is used as a support and has the following dimensions:

| | |
|---|---|
| angle at the vertex | 20° |
| height | 170 mm |
| diameter of the base | 100 mm |
| diameter at the vertex | 40 mm |

A circular braiding machine is used which is equipped with 36 spindles and having rotating tensioning bars and yarn-guides, the tension being strictly equal from one tow to another.

Each spindle is provided with a graphite tow which has a modulus of elasticity under tension of 38,000 hectobars and a tensile strength of 210 hectobars, weighing 3.6 g/m undoubled, and having been sized beforehand with an epoxy resin.

The item in the shape of a truncated cone is mounted on a mandrel coaxial with the braiding machine, and its rotational and translational motion are blocked.

The braiding is set to an angle of about 30° and, initially, the narrowest part of the item is braided; variable-angle braiding is carried out in such a way that the braiding point moves along the generatrix. The angle reaches 60° at the other end of the item.

A flexible braided structure having a constant thickness of 1.5 mm is obtained and withdrawn from the mandrel.

EXAMPLE 2

This item which is covered is used as a support and possesses, successively, a cylindrical part having a diameter of 30 mm, a part in the shape of a truncated cone which has an angle of 22° at the vertex, and a further cylindrical part having a diameter of 100 mm.

The braiding apparatus is provided with 36 spindles, 18 of which are equipped with a carbon tow weighing 3.6 g/m and sized with epoxy resin, and the other 18 of which are equipped with continuous glass fibers weighing 3.6 g/m and sized with a conventional silane-type product, the spindles being fed alternately with carbon fibers and glass fibers.

The item is mounted on a mandrel which is prevented from rotating and which has a non-uniform translational motion, making it possible to produce a braiding with contiguous spirals.

Laying-down is carried out starting with the part of greatest diameter, with uniform forward movement in the cylindrical parts and accelerated forward movement in the conical parts.

| | |
|---|---|
| Braiding angle of the cylindrical part of greater diameter | 70° |
| Braiding angle of the part in the shape of a truncated cone varies from 70° to 28° | |
| Braiding angle of the second smaller cylindrical part | 28° |

A flexible article is thus obtained which possesses contiguous spirals and has a uniform thickness of 1.5 mm, as shown in the accompanying FIG. 1.

What is claimed is:

1. A flexible, three-dimensional, shaped article which consists essentially of a flexible, unimpregnated, two-dimensional braided structure made of non-braided yarns or tows having a variable crossing angle and based on fibers selected from the class consisting of graphite fibers and carbon fibers, said shaped article having a varying cross-section.

2. A shaped article according to claim 1, wherein the braided structure has a constant thickness.

3. A shaped article according to claim 1, comprising several superposed layers of the braided structure.

4. A shaped article according to claim 3, wherein the superposed layers are separated by an intercalated non-slip layer.

5. A shaped article according to claim 3, wherein the superposed layers are separated by an intercalated adhesive layer.

6. A shaped article according to claim 1, wherein yarns or tows of two or more materials of different nature are used.

7. A shaped article according to claim 1, wherein strengthening yarns are incorporated parallel to the axis of the said article.

8. A process for the production of the article according to claim 1, wherein continuous circular braiding is employed and in which the rate of deposition may be adjusted by varying the braiding angle.

* * * * *